United States Patent [19]

Koyama

[11] 4,192,604

[45] Mar. 11, 1980

[54] BIAS VOLTAGE SOURCE FOR APPLYING A BIAS VOLTAGE ON A MAGNETIC BRUSH MEANS OF AN ELECTROSTATIC PRINTING APPARATUS

[75] Inventor: Mitsuaki Koyama, Higashikurume, Japan

[73] Assignee: Tokyo Shibaura Electric Co., Ltd., Kawasaki, Japan

[21] Appl. No.: 882,141

[22] Filed: Mar. 1, 1978

[30] Foreign Application Priority Data

Mar. 9, 1977 [JP] Japan ..... 52-25631

[51] Int. Cl.[2] ..... G03G 21/00

[52] U.S. Cl. ..... 355/3 DD; 361/235

[58] Field of Search ..... 96/1 SD; 118/657, 658; 335/3 DD, 14; 361/225, 226, 235

[56] References Cited

U.S. PATENT DOCUMENTS

| | | | |
|---|---|---|---|
| 2,880,699 | 4/1959 | Hayford | 355/3 DD |
| 3,654,893 | 4/1972 | Piper et al. | 355/3 DD |
| 4,113,374 | 9/1978 | Nakamura et al. | 355/14 |

OTHER PUBLICATIONS

Trachtenberg et al., "Induction Plate Bias Control for Electrophotographic Development", Report 13335, Kodak Research Disclosure, May 1975.

*Primary Examiner*—A. D. Pellinen

*Attorney, Agent, or Firm*—Cushman, Darby & Cushman

[57] ABSTRACT

This invention provides a bias voltage source for an electrostatic printing apparatus, which controls the movement of toner powder by a potential difference between a photosensitive layer on a cylindrical drum and a magnetic brush. The bias voltage source is provided with a charge storage circuit formed of a resistor connected between the output terminal of said bias voltage source and rectification circuit, and capacitor. When power is turned off, electric energy stored in the capacitor is slowly discharged through the resistor of the charge storage circuit so that the output voltage of the bias voltage source attenuates slowly, thereby preventing toner powder from being attracted to the photosensitive layer.

5 Claims, 4 Drawing Figures

BIAS VOLTAGE SOURCE FOR APPLYING A BIAS VOLTAGE ON A MAGNETIC BRUSH MEANS OF AN ELECTROSTATIC PRINTING APPARATUS

BACKGROUND OF THE INVENTION

This invention relates to an electrostatic printing apparatus provided with a magnetic brush means, and more particularly to improvements on a bias voltage source for applying a bias voltage to the magnetic brush means of the electrostatic printing apparatus.

Already known is the so-called 2 rotations - 1 copy type electrostatic printing apparatus which is provided with a magnetic brush means; while a cylindrical drum makes two rotations, develops a latent electrostatically charged image or pattern produced on a photosensitive layer mounted on the outer peripheral surface of a cylindrical drum and cleans toner powder deposited on the photosensitive layer. The above-mentioned type of electrostatic printing apparatus generally includes a bias voltage source for applying a bias voltage to the magnetic brush apparatus, controls the movement of the toner particles of the magnetic brush by a potential difference produced by a bias voltage between the magnetic brush means and the photosensitive layer of the cylindrical drum, and undertakes both the development of an electrostatically charged image or pattern and the cleaning of toner particles deposited on the photosensitive layer.

With the above-mentioned type of electrostatic printing system, the problem has hitherto been pointed out that a paper sheet copied by said printing apparatus is contaminated by black band-like soils. These soils appear on that portion of the copied sheet which corresponds to the region of the photosensitive layer of the cylindrical drum contacted by the magnetic brush while the cylindrical drum stands at rest. The contamination is caused by the fact that part of the toner particles of the magnetic brush is deposited on the photosensitive layer of the drum and then undesirably transferred on to a copy sheet. It can be inferred from this fact that the aforesaid contamination does not occur while the drum is kept rotated for continuous copying, but that once the drum stands at rest, the subsequent copying is often accompanied with the contamination.

Experimental study of the above-mentioned black band contamination shows that this event arises from two causes, that is, the electrostatic deposition of part of the toner particles of the magnetic brush on a photosensitive layer of the drum and the mechanical accumulation of part of the toner particles of the magnetic brush on the photosensitive layer of the drum; the latter cause, namely contamination resulting from the mechanical attachment of toner particles to the photosensitive layer of the drum is easily eliminated during the subsequent step of development and does not appear on a copy sheet; after all, the aforesaid black band contamination is mainly caused by the former electrostatic deposition of toner particles on the photosensitive layer of the drum; the higher the concentration of toner particles in a developer mixture, the more prominent the black band contamination; and the lower the electric charge of toner particles, the less noticeable the black band contamination.

In view of the above-mentioned facts, the present inventor previously applied the under-mentioned processes to an electrostatic printing apparatus.

A toner powder used was charged with a larger amount of electric energy to provide a stronger electrostatic attractive force between the toner powder of the magnetic brush and the magnetic carrier. A photosensitive layer on the cylindrical drum was made to have a lower residual potential. These two processes indeed decreased the soiling of a copy sheet, but still proved ineffective. Therefore, difficulties accompanying an electrostatic printing apparatus have not yet been resolved.

SUMMARY OF THE INVENTION

It is accordingly the object of this invention to provide a bias voltage source for applying a bias voltage to the magnetic brush of the electrostatic printing apparatus, thereby preventing part of the toner particles from being electrostatically deposited on the photosensitive layer of the cylindrical drum contacted by the magnetic brush when said drum is brought to rest.

According to an aspect of this invention, there is provided a bias voltage source for applying a bias voltage on a magnetic brush means of an electrostatic printing apparatus to supply said magnetic brush means with a prescribed potential, wherein said electrostatic printing apparatus includes a rotary cylindrical drum having a photosensitive layer mounted on the outer peripheral surface, and said magnetic brush means providing a magnetic brush formed of a mixture of a magnetic carrier and a toner powder and normally contacting the photosensitive layer of said cylindrical drum; while the cylindrical drum makes two rotations, varies the potentials of the photosensitive layer and magnetic brush means and completes the steps of developing a latent electrostatic charge pattern formed on the photosensitive layer and cleaning toner particles remaining on the photosensitive layer, the improvement being that said bias voltage source further comprises a transformer whose primary winding is connected to an A.C. power source through a switch which is opened when the rotation of the cylindrical drum is brought to rest; a rectifier circuit connected to the secondary winding of the transformer; and a charge storage circuit formed of a resistor and capacitor cooperating slowly to attenuate a bias voltage applied to the magnetic brush means when the switch is opened, and between the rectifier circuit and magnetic brush means.

DETAILED DESCRIPTION OF THE PREFERRED EMBODIMENTS

Figure 1:
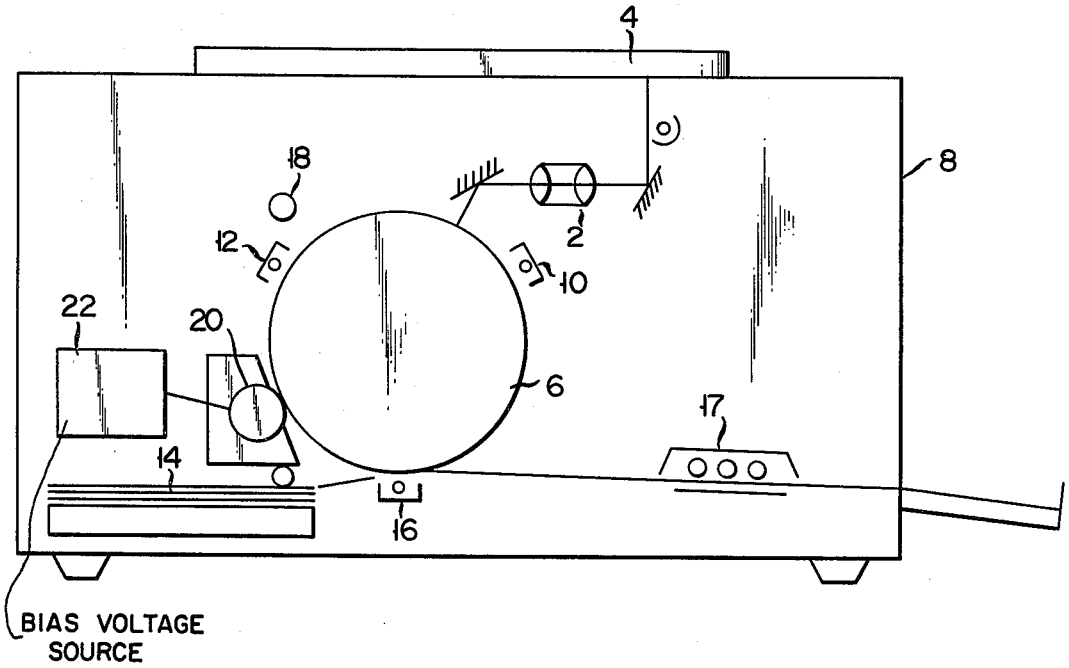
FIG. 1 is a schematic cross sectional view of an electrostatic printing apparatus including a bias voltage source according to this invention for applying a bias voltage to a magnetic brush means.

Brief description is first given by reference to FIG. 1 of the so-called 2 rotations -1 copy type electrostatic printing apparatus provided with a magnetic brush means, before a detailed description is made of a bias voltage source embodying this invention for applying a bias voltage to the magnetic brush of the electrostatic printing apparatus.

Referring to FIG. 1, an optical system 2 formed of a lens and mirror is received in a housing 8 for the photographic projection of an image of a document 4 being copied on a rotary cylindrical drum 6. As is well known, a photosensitive layer is mounted on the outer peripheral surface of the cylindrical drum 6. A latent electrostatic charge pattern corresponding to an image projected by the optical system 2 is produced on the surface of said photosensitive layer. A first charge means 10 for uniformly charging a photosensitive layer in a developing process, an A.C. corona charge means 12 for discharging the electric energy of the photosensitive layer in a cleaning process and a transcription charge means 16 for transferring a toner powder deposited on the photosensitive layer on to a copy sheet 14 are all disposed around the cylindrical drum in the order mentioned as counted counterclockwise of FIG. 1. The housing 8 further contains a fixing means 17 for fixing a toner powder on the copy sheet 14. Positioned near the A.C. corona charge 12 is a lamp 18 for eliminating an electric charge still remaining in the photosensitive layer in the cleaning process. A magnetic brush means 20 is set between the A.C. corona charge means 12 and transcription charge means 16. The magnetic brush means 20 comprises a magnetic roller which contains a plurality of permanent magnets and whose peripheral sleeve is made rotatable, and a receptacle for receiving a developer formed of a mixture of a toner powder and magnetic carrier. The magnetic brush means 20 causes a developer to be attracted to the magnetic roller, thereby continuously supplying the photosensitive layer with the magnetic brush material. A bias voltage source 22 connected to the magnetic brush means 20 impresses a bias voltage on the magnetic brush means 20 during the developing and cleaning processes. Where a toner powder is of the type which is positively charged by friction in the developer receptacle, then the magnetic brush means 20 connected to the bias voltage source 22 is supplied with a higher potential during the developing process than the photo-sensitive layer of the cylindrical drum 6 in which a latent electrostatic charge pattern is formed. As the result, the magnetic brush means 20 is applied with a sufficiently high bias voltage to cause a charged toner powder to be attracted to the photosensitive layer.

During the cleaning process, the bias voltage source 22 causes the magnetic brush means 20 to have a lower potential than the photosensitive layer whose residual charge is eliminated by the A.C. corona charge means 12 and elimination lamp 18. Consequently, the magnetic brush means 20 is applied with a sufficient bias voltage to attract a toner powder to the magnetic brush.

The present inventor's experiments and study have disclosed the cause by which toner particles are deposited on the photosensitive layer of the prior art electrostatic printing apparatus arranged as described above when the rotation of the cylindrical drum is brought to rest. When the copying operation is brought to an end, the magnetic brush is released of a bias voltage. In this case, the inventor has discovered that the shorter the length of time in which the bias voltage falls to zero volts, namely, the more rapid a drop in the bias voltage, then the larger the amount of toner particles attached to the photosensitive layer of the cylindrical drum.

The cause leading to the appearance of the above-mentioned event may be explained as follows. At the time of development and cleaning, the magnetic brush means is applied with a prescribed level of bias voltage. A specified amount of electric energy is charged in the magnet roll of the magnetic brush means and an iron powder carrier of the magnetic brush means. When a bias voltage is suddenly cut off from this charged state, the electric charge of the magnet roll having a low resistance is immediated eliminated. But with the magnetic brush having a high resistance, electric energy is slowly discharged from that portion of the magnetic roller which lies close to the peripheral sleeve. Where said discharge rapidly takes place, an electric charge of the opposite polarity is induced in that part of the magnetic brush which lies remote from the peripheral sleeve. Consequently, the electric charge thus induced and the charge of a toner powder have the same polarity, causing part of the toner particles of the magnetic brush to be electrostatically repelled to settle on the photosensitive layer of the cylindrical drum. This event arises due to the magnetic brush having a high impedance. Where the magnetic brush is regarded as a condenser model if viewed as an equivalent circuit, then it will be easily understood that the cause giving rise to the above-mentioned event results from the same principle as that by which application of A.C. voltage on the condenser model leads to the alternate generation of positive and negative forms of voltage at both ends thereof.

Deposition of toner particles on the photosensitive layer arises from the fact that the toner particles are expelled from the magnetic brush on to the photosensitive layer by a charge occurring in the magnetic brush by polarization. In view of the above-mentioned difficulties, the present inventor has proposed the undermentioned bias voltage source designed to apply a bias voltage to the magnetic brush means 20 in such a manner as prevents the potential of said magnetic brush means 20 from being rapidly decreased.

There will now be described by reference to FIGS. 2 to 4 a bias voltage source 22 embodying this invention. As seen from FIG. 2, the bias voltage source 22 comprises a transformer whose primary winding is connected to an A.C. power source through a switch 25; a rectifier circuit 26; and a charge storage circuit 28 connected between the rectifier circuit 26 and magnetic brush means 20 to suppress the occurrence of a sudden drop in the bias voltage when the switch 25 of the bias voltage source is opened. This switch 25 is closed while the cylindrical drum is rotated, and is opened when the rotation of the cylindrical drum is brought to rest. As is well known, the rectifier circuit 26 comprises a series circuit formed of a diode 30 and a grounded filter capacitor 32 having a relatively small capacitance and connected to the secondary winding of the transformer 24; a protective resistor 34 having a relatively low resistance for protection of the filter capacitor 32 and connected in parallel thereto; and a protective resistor 38 connected between the diode 30 and the output terminal 36 of the bias voltage source 22 for protection of the magnetic brush means 20. The protective resistor 38 is connected to a grounded capacitor 40 of the charge storage circuit 28. Though this time constant circuit 28 is formed of a resistor and capacitor, said resistor is concurrently served by the protective resistor 38 of the rectifier circuit 26. The above-mentioned charge storage circuit 28 has a very important function for the bias voltage source of this invention which applies a bias voltage to the magnetic brush means 20 of the electrostatic printing apparatus constructed as described above. With the prior art bias voltage source, when an A.C. voltage suddenly ceases to be applied to the transformer 24 when the rotation of the cylindrical drum 6 is brought to rest and the switch 25 is closed, then the electric energy charged in the filter capacitor 32 is rapidly discharged through the protective resistor 34, because said filter capacitor 32 has a small capacitance and the protective resistor 34 has a low resistance. Therefore, a bias voltage generated at the output terminal of the prior art bias voltage source suddenly drops, causing toner particles to be rapidly expelled from the magnetic brush to the photosensitive layer of the cylindrical drum 6. With the bias voltage source 22 of this invention, however, which is provided with the charge storage circuit 28 as mentioned above, a bias voltage generated at the output terminal 36 of the bias voltage source 22 does not suddenly drop even when an A.C. voltage ceases to be impressed on the transformer 24 due to the turn off of the switch 25, but slowly falls. The reason is that the electric energy stored in the capacitor 40 of the charge storage circuit 28 is slowly discharged through the resistors 38, 34, causing a voltage generated at the output terminal 36 of the capacitor 40 to drop slowly. With the bias voltage source of this invention, the length of time in which the bias voltage falls is extended by a value substantially expressed by a product $C_0 \times R_1$ of the capacitance $C_0$ of the capacitor 40 and the resistance $R_1$ of the protective resistor 38. Various tests on the foregoing embodiment show that where the product $C_0R_1$ increases over 100 milliseconds, toner particles are prominently prevented from being deposited on the photosensitive layer of the cylindrical drum 6. A value of 100 milliseconds fully serves the purpose even when the kind of a developer, particularly the electric resistance of a toner powder appreciably varies.

Figure 2:
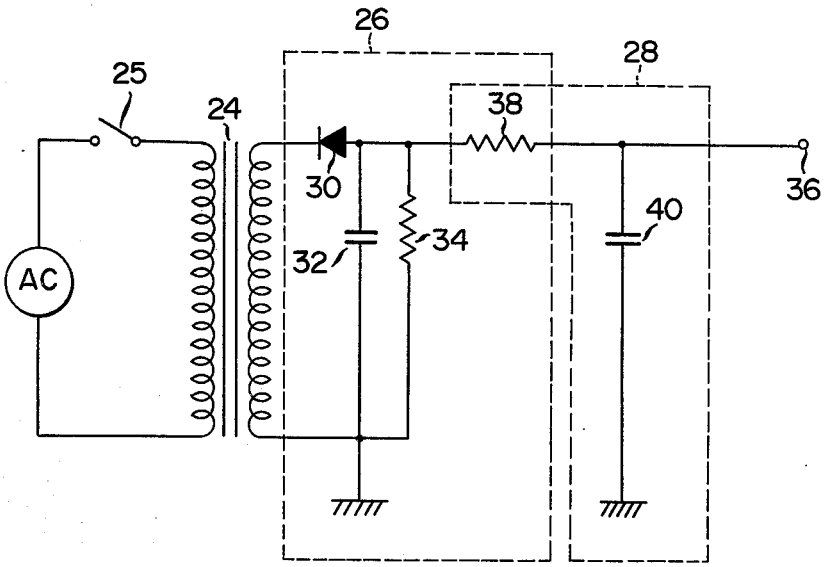
FIGS. 2 to 4 show the circuit arrangements of a bias voltage source embodying the invention for applying a bias voltage to the magnetic brush means and other modifications of said embodiment.
Figure 3:
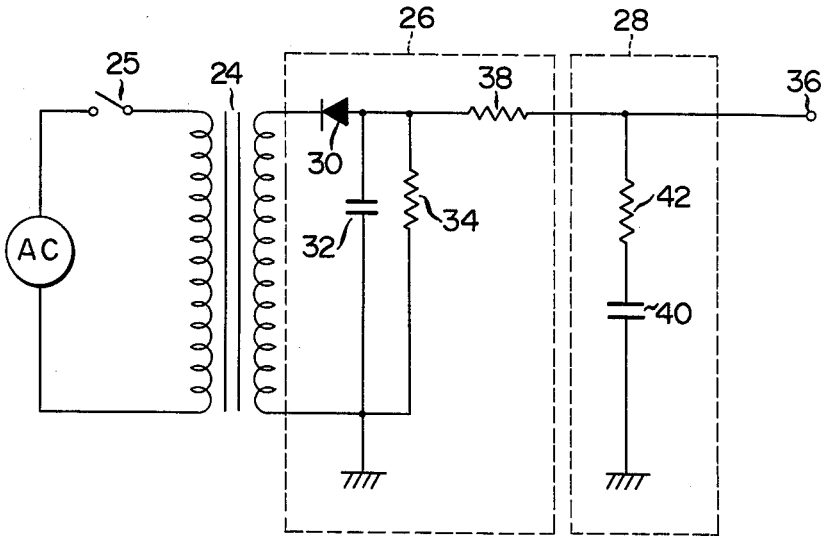
Figure 4:
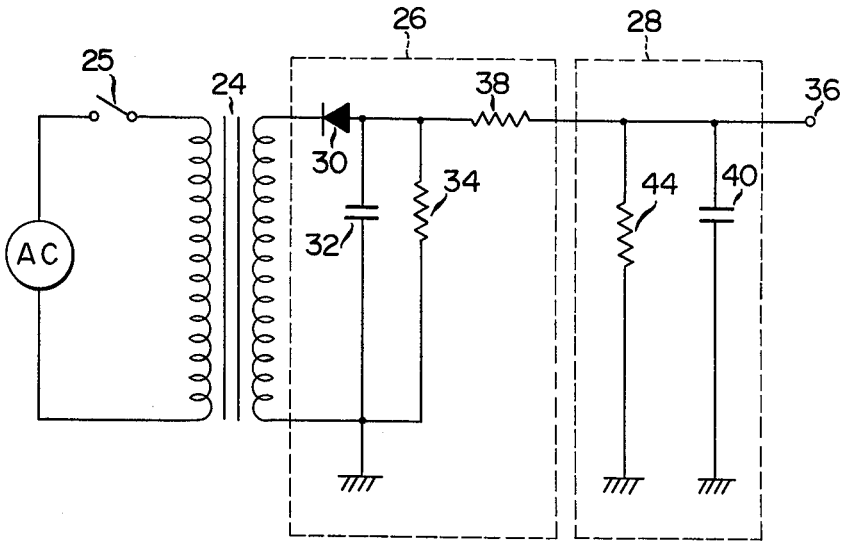

The bias voltage sources of FIGS. 3 and 4 are modifications of that of FIG. 2. Referring to FIG. 3, a resistor 42 for use with the charge storage circuit 28 is connected to a junction between the output terminal 36 of the bias voltage source 22 and protective resistor 38, and also connected to the capacitor 40. The reason why the resistor 42 is connected between the aforesaid junction and the capacitor 40 is that where the protective resistor 38 has an unduly high resistance, then the bias voltage source 22 displays too large an impedance, for use as a voltage source. The modification of FIG. 3 makes it possible freely to select the resistance $R_2$ of the resistor 42, cause the bias voltage to drop in a length of time $C_0 \times (R_1 + R_2)$, and also reduce the output impedance of the bias voltage source 22 to a preferred level. Experiments show that at the time of $C = 0.1\ \mu F$, $R_1 = 220\ K\Omega$ and $R_2 = 1\ M\Omega$, the modification of FIG. 3 gives the most satisfactory result.

Referring to the modification of FIG. 4, a resistor 44 of the charge storage circuit 28 is connected in parallel to the capacitor 40. As in the modification of FIG. 3, that of FIG. 4 enables the bias voltage to fall in a considerably extended length of time ($C_0 \times R_3$ where $R_3$ is the resistance of the resistor 44) without increasing the output impedance of the bias voltage source 22. The arrangement of the rectifier circuit 26 of the bias voltage source 22 may be freely varied and be replaced by any other type of rectifier circuit.

There will now be described by reference to FIG. 1 the operation of an electrostatic printing apparatus provided with the bias voltage source 22 of this invention. When the cylindrical drum 6 begins to be rotated upon depression of a button, the first charge means 10 is actuated, causing the photosensitive layer of the cylindrical drum 6 to be charged to −500 volts. Then, the images of the manuscript 4 are projected on the photosensitive layer of the drum 6 through the optical system 2 to form latent electrostatic images. These images are successively brought to the magnetic brush means 20 to be developed into a visible form. At this time, the bias voltage source 22 applies a development bias voltage of about −200 volts on the magnetic brush means 20. When the cylindrical drum makes a further rotation, a transcription copy sheet 14 is placed on the latent image electrostatically formed on the photosensitive layer of the drum 6. A negative corona is applied to the copy sheet 14 by means of the transcription charge means 16, causing the image to be transcribed on the copy sheet 14. The copy sheet 14 on which the image has been transcribed is taken off the cylindrical drum 6 and, after passing through the fixing means 17, is removed from the printing apparatus. Thereafter, the drum 6 continues rotation to clean toner particles still remaining on the photosensitive layer after transcription. These residual toner particles are preliminarily eliminated by the lighting of the elimination lamp 18 and later thoroughly by the A.C. corona charge means 12. Thereafter the specified portion of the drum 6 is brought back to the magnetic brush means 20. At this time, the magnetic brush means 20 is applied with a cleaning bias voltage of −100 volts to carry out the successive cleaning of toner particles left on the photosensitive layer of the drum 6. Upon completion of the cleaning, the printing apparatus is brought to rest and the bias voltage source 22 is rendered inoperative. Since, at this time, the bias voltage source 22 causes the bias voltage to drop in the aforesaid larger length of time than 100 milliseconds, toner particles are prevented from being deposited on that portion of the photosensitive layer of the drum 6 which is contacted by the magnetic brush when the rotation of the drum 6 is brought to rest. Consequently, a fresh copy sheet used in the succeeding copying operation is saved from a black band contamination caused by the soiling of the contact portion which might otherwise occur.

As mentioned above, an electrostatic printing apparatus provided with the bias voltage source 22 of this invention which undertakes both development and cleaning by the same magnetic brush means suppresses the occurrence of a black band contamination on a copy sheet, providing a clean impression of high quality.

What is claimed is:

1. A bias voltage source for applying a bias voltage to a magnetic brush which contacts a photosensitive surface of a rotatable cylindrical drum, comprising:

a transformer whose primary winding is connected to an input power source;

a switch means which is connected between the power source and the primary winding of said transformer and is opened when the rotation of the cylindrical drum is brought to rest;

a rectifier circuit connected to the secondary winding of said transformer and including a series circuit formed of a uni-directional current flow means and an energy storage means, and a protective resistor connected between said uni-directional current flow means and magnetic brush means to protect said magnetic brush means; and charge storage means connected between said energy storage means and the magnetic brush and including a capacitor connected in parallel to said energy storage means through said protective resistor for the magnetic brush means for slowly attenuating a bias voltage applied to the magnetic brush when said switch means is opened.

2. The bias voltage source according to claim 1, wherein a voltage applied to the charge storage means does not drop in a shorter length of time than 100 milliseconds.

3. A bias voltage source for applying a bias voltage to a magnetic brush which contacts a photosensitive surface of a rotatable cylindrical drum, comprising:

a transformer whose primary winding is connected to an input power source;

a switch means which is connected between the power source and the primary winding of said transformer and is opened when the rotation of the cylindrical drum is brought to rest;

a rectifier circuit including a series circuit formed of a filter capacitor and a diode which are connected to the secondary winding of the transformer, a first protective resistor connected in parallel to the filter capacitor for its protection, and a second protective resistor connected between the diode and magnetic brush means to protect said magnetic brush means; and a charge storage means formed of the second protective resistor for the magnetic brush means of the rectifier circuit and a charge capacitor connected in parallel to the filter capacitor through said second protective resistor for the magnetic brush means for slowly attenuating a bias voltage applied to the magnetic brush when said switch means is opened.

4. The bias voltage source according to claim 3, wherein the charge storage means further comprises a resistor connected between said second protective resistor for the magnetic brush means and the charge capacitor.

5. The bias voltage source according to claim 3, wherein the charge storage means further comprises a resistor connected in parallel to the charge capacitor.

* * * * *